United States Patent [19]

Flinchbaugh

[11] 4,221,011

[45] Sep. 9, 1980

[54] APPARATUS AND METHOD FOR LIFTING THE HANDICAPPED

[75] Inventor: Henry K. Flinchbaugh, York, Pa.

[73] Assignee: Flinchbaugh/Murray Corporation, York, Pa.

[21] Appl. No.: 953,564

[22] Filed: Oct. 23, 1978

[51] Int. Cl.[2] ..... A61G 1/02

[52] U.S. Cl. ..... 5/89; 5/86

[58] Field of Search ..... 5/81 R, 86, 89, 317 R, 5/384; 297/385; 128/134

[56] References Cited

U.S. PATENT DOCUMENTS

| | | | |
|---|---|---|---|
| 3,234,568 | 2/1966 | Fischer | 5/89 |
| 3,474,781 | 10/1969 | Gaylord, Jr. | 5/317 R |
| 3,996,632 | 12/1976 | Bakker | 5/86 |
| 3,999,227 | 12/1976 | Ingemansson | 5/81 R |

*Primary Examiner*—Casmir A. Nunberg

*Attorney, Agent, or Firm*—Paul and Paul

[57] ABSTRACT

A sling for lifting a handicapped person and method utilizing the sling are provided. The sling is fabricated from a pair of tubular members which are retained in spaced relation by a channel member integral with the tubular members with which they are pivotally mounted. An overhead sling having a rigid portion and a flexible portion supports each of the tubular members while maintaining head clearance for the person who is using the sling. The sling also contains a lifting eye which is secured to the rigid portion of the sling, a pair of leg slings mounted with the channel member for supporting the upper legs of the persons, and a pair of arm slings for supporting the persons' arms. Tie straps are secured to the tubular members and the arm slings to prevent the person's arms from flaying outwardly from the body.

8 Claims, 3 Drawing Figures

APPARATUS AND METHOD FOR LIFTING THE HANDICAPPED

BACKGROUND OF THE INVENTION

1. Field of the Present Invention

This invention relates to slings, and more particularly to slings for lifting and transporting a handicapped person; such slings are contemplated for use in combination with various lifting and transporting devices.

2. Prior Art Statement

The prior art relating to lifting and transporting slings for persons, including handicapped persons, is a rather diverse one featuring various systems for supporting the body of the person to be lifted.

One of the significant subclasses of such sling systems provides a chair-like support generally of a flexible but supportive material working in combination with a back support either attached to the chair-like support or independent of same, all of which is supported by a harness mechanism. In some of these supports a head support is also provided. See, for example, U.S. Pat. Nos. 2,339,007, 3,234,568 and 3,351,959.

In another subclass of such sling systems, a system of independent supports is provided to accommodate a handicapped person and particularly, is designed to more efficiently be attached to a handicapped person while the person is sitting, so that a minimum effort in harnessing that person or securing the person in the sling is required. See, for example, British Pat. No. 950,017 and French Pat. No. 2,287,211.

In many respects, the latter subclass has advantages in that a handicapped person may be transported from one location to another without requiring lifting of that person to insert the various slings and other supports. However, the prior art disclosures relative to this subclass fall short of the present invention, which completely eliminates the necessity for an attendant or nurse to lift the patient or have to manipulate the patient to position the conventional type slings under the buttock or rump, or the like.

It is therefore an object of the present invention to efficiently support and transport a handicapped person.

A further object of the present invention is to provide a sling which supports the handicapped person in a manner which conveniently positions the support members around selected appendages of the person fully and comfortably supporting variously sized persons.

Still a further object of the present invention is to provide a sling which facilitates its engagement or disengagement with the person to be supported, without requiring an attendant or nurse to lift the patent or handicapped person or to manipulate the various woven slings under the buttock or rump, and the like.

It is still a further object of the present invention to provide a sling which permits the efficient transportation of the handicapped person from one location to the other by a mechanical lifter, such as transporting a patient from a bed to a wheelchair, to a bath, to a commode, etc., and vice versa.

Still yet a further object of the present invention is to provide a sling which can be universally utilized with various kinds of lifting and transportation supports.

Still yet a further object of the present invention is to provide an apparatus featuring four adjustable independent slings for each arm and leg which afford advantages including freedom of arranging the clothing on the supported handicapped person for use of the commode, for assisting in undressing, for assistance in bedding down and for the bath.

Still yet another object of the present invention is to provide a sling which in combination with powered hoists having remote or cord controls will enable the handicapped or paraplegics to improve their independence and self care.

SUMMARY OF THE INVENTION

The above objects are fulfilled by the present invention which features an overhead sling slidably engaging a pair of tubular members for supporting the tubular members and maintaining head clearance, a channel member engaging each of the tubular members in pivotal relation for retaining the tubular members in spaced relation to each other while permitting same to pivot about each end of the channel member, a pair of leg slings adjustably secured to the channel member and engaging each of the upper legs of the handicapped person and a pair of arm slings each adjustably secured to the tubular members for engagement with each of the forearms of the handicapped person.

The arm slings and leg slings are of a woven soft material to distribute the pressures of the weight of the body and its members and to prevent injury and discomfort. The arm and leg slings each have arrangements which incorporate a length of chain and spring lock hook to allow adjustment for comfort and weight distribution. The arm slings have a pair of arm cushions each secured to the tubular members.

The tubular members are so shaped and arranged so as to permit the patient to grasp same with each hand for a more comfortable and secure feeling.

Other features of the present invention will be more fully understood in view of the description of the drawing figures, the detailed description of the preferred embodiment and the appended claims.

DETAILED DESCRIPTION OF THE PREFERRED EMBODIMENT

Figure 1:
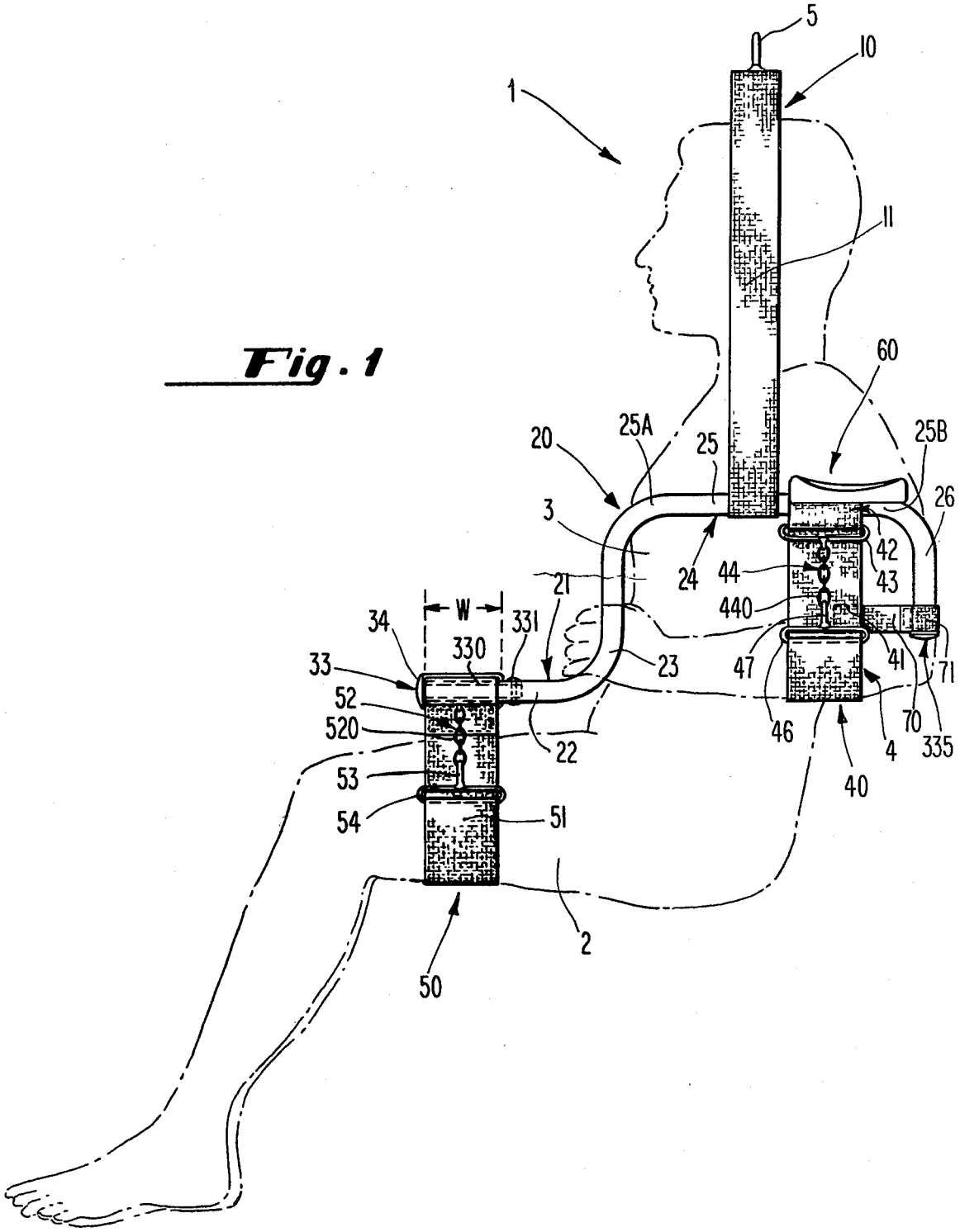
FIG. 1 is a perspective view of the sling of the present invention as shown supporting a handicapped person.
Figure 2:
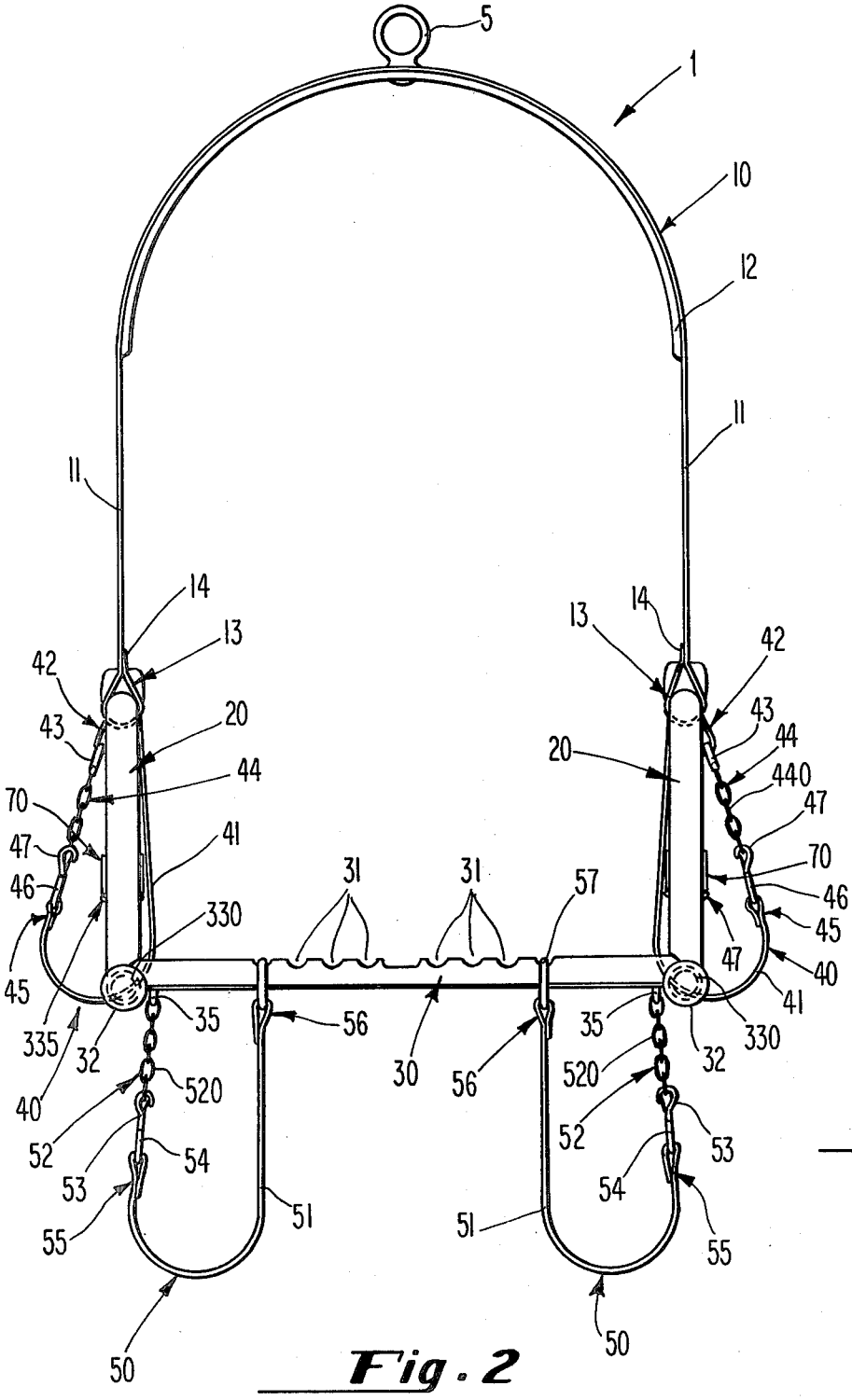
FIG. 2 is a front view of the sling of the present invention.

Referring now to FIGS. 1 and 2, there is shown a preferred embodiment of the present invention. Sling 1 of the present invention generally comprises an overhead sling 10, a pair of tubular support members 20, a channel member 30, a pair of arm slings 40, and a pair of leg slings 50. Lifting eye 5 is attached to overhead sling 10 and provides a means to secure sling 1 to various hoists and other apparatus which can be used in conjunction with sling 1 to lift and/or transport sling 1 and a handicapped person supported therein. It will be understood that the present invention is comprised of several identical elements and members, as witnessed above, and that the description of any one of these identical elements or members will apply equally to it's counterparts.

Referring now to FIG. 2 it is seen that overhead sling 10 is formed of a woven cotton material forming flexible portion 11 and arch shaped rigid support 12, which is fabricated of lightweight rigid metal such as, for example, aluminum, or may be fabricated of a heavy guage plastic material, and the like. Flexible portion 11 is secured to rigid support 12 by rivets (not shown) which pass through flexible portion 11 and are affixed with rigid support 12. Lifting eye 5 likewise passes through flexible portion 11 and is likewise secured to rigid support 12. Flexible material 11 has a length which is sufficient to extend along arch shaped rigid support 12 and beyond, extending downwardly on each side of said support where it is secured at each end 14 to itself forming sling 13 which supports each tubular member of the pair of tubular members 20 by extending beneath them. Flexible material 11 is secured at 14 by sewing the woven material together, but may be riveted, secured by gromets, or the like, as is known in the art.

As thus far described, overhead sling 10 utilizes the arch shaped rigid support 12 to form an arch for head clearance of the patient with flexible portion 11 permitting tubular members 20 to fold inwardly and down for compactness in handling and storage, as is more fully described hereinafter.

Referring now to FIG. 1, tubular member 20 comprises a generally L-shaped front end portion 21 having a first portion 22 which substantially parallels the upper leg portion 2 of the handicapped person and a second portion 23 which bends upwardly and substantially parallels torso 3 of the handicapped person. Tubular member 20 also contains rear-end portion 24 forming a generally inverted U-shaped member having a first portion or base portion 25 and a second or hind-end portion 26.

Figure 3:
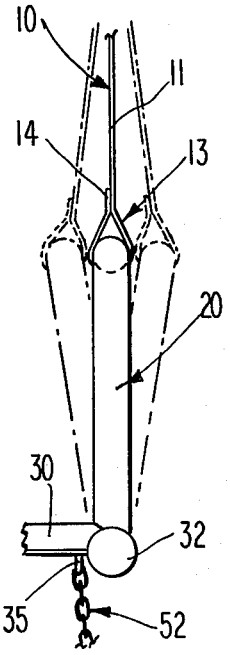
FIG. 3 is a view in section, of the interaction between the overhead sling, the tubular member, and channel member of the present invention showing the tubular member pivoting about the channel member.

As is best shown in FIGS. 2 and 3, tubular members 20 are pivotally mounted with channel shaped member 30, which operates to maintain tubular members 20 in spaced relation with respect to each other while permitting each of the tubular members 20 to fold inwardly and downwardly.

Tubular members 20 and channel member 30 are formed of a lightweight metallic material, and preferably, of a material such as aluminum. Channel member 30 is a channel shaped containing bar having two end portions 32 which are tubular in nature, each having an internal diameter sufficient to extend over the external diameter of front end portion 21 of tubular members 20. Tubular ends 32 therefore permit pivotal movement of the tubular members with respect to channel member 30. This permits both adjustment of sling 1 and particularly the inward or outward adjustment of tubular members 20 to accommodate variously sized persons (i.e. heavy, skinny, broad shouldered, etc) as well as helping to permit sling 1 to fold into a compact unit. Channel member 30 additionally contains two sets of notches 31 whose function will be more fully described hereinafter.

Caps 33 have heads 34, which are of sufficient diameter to form a shoulder which prevents channel member 30 from sliding off front end portion 21 of tubular members 20. Caps 33 also have a tubular body 330 which fits snuggly within the internal diameter of tubular member 20 extending through the tubular member for a distance greater than width "W" of channel member 30 for a distance sufficient to permit pin 331 to pass through tubular member 20 and body 330 to secure channel member 30 into position.

Referring now to FIG. 1, flexible material 11 of overhead sling 10 is looped beneath tubular members 20 at their base portions 25 and secured to themselves as described above. As is best shown in FIG. 2 looped portions 13 of flexible member 11 form slings which permit base portion 25 of tubular members 20 to slide along looped portions 13 to premit forceable adjustment of overhead sling 12 relative to tubular members 20 for centering the weight of the suspended handicapped person to achieve a comfortable upright position. Base portion 25 has a front portion 25A and a rear portion 25B, and as is shown in FIG. 1, underarm cushion 60 is provided at rear-end portion 25B of base portion 25 of tubular members 20 to accommodate and cushion the person's underarms.

Underarm cushion 60 is fabricated of a soft, pliable rubber, but may be a plastic material. Prior to securing underarm cushion 60 to tubular members 20, arm sling 40 is secured to tubular members 20 by fabricating sling portion 42 beneath underarm cushion 60 in the same manner in which flexible material 11 is secured to tubular members 20 to form sling portion 13. Arm sling 40 is secured in place by the securing of underarm cushion 60, which in the preferred embodiment is done by riveting same to tubular member 20. Inserted into sling portion 42 of arm sling 40 is an elongate ring 43 which is supported by sling portion 42 and has attached thereto a length of chain 44. The flexible portion of arm sling 41 fabricated of woven cotton material forms another sling portion 45 which is fabricated similar to sling portions 42 and 13, above, (see FIG. 2). A second elongate ring 46 is inserted into sling portion 45; it has attached thereto lock hook 47. In operation of arm sling 40 as thus far described, lock hook 47 is secured to one of the rungs 440 of length of chain 44 to form arm sling 40 for support of the forearm 4 of the handicapped person as is best shown in FIG. 1.

Another feature of the present invention is that it prevents the handicapped person's arms from flaying outwardly by utilizing tie strap 70 which is secured as follows: tie strap 70 is sewn at one end to arm sling 40 and at its other end is secured to hind-end portion 26 of tubular member 20 by sling portion 71, which is fabricated the same as sling portions 45, 52, and 13, above.

Tie strap 70 is prevented from falling off tubular members 20 by cap 335.

Referring now to FIG. 2, leg slings 50 are secured to channel member 30 by ring 35, which is welded or otherwise secured to channel member 30 from which length of chain 52 having rungs 520 is suspended. Lock hook 53 is secured to elongate ring 54 which has one portion thereof secured within loop portion 55 of woven material 51 of leg sling 50 (loop portions 55 being fabricated identically as loop portions 42 and 45 of arm slings 40). Woven material 51 forms a generally U-shaped portion which extends upwardly to a second looped portion 56 which is secured to elongate ring 57. One portion of elongate ring 57 slips within loop portion 56 with the other portion encompasses channel member 30, resting in supportive fashion in one of notches 31 of channel member 30 to permit adjustment of leg slings 50. This permits adjustments to promote the comfort and compensate for weight distribution of the handicapped person.

As thus far described, sling 1 of the present invention provides a novel method of lifting a handicapped person by engaging the upper legs of the person utilizing leg slings 50, engaging the forearms 4 of the handicapped person utilizing arm slings 40, and lifting the handicapped person as thusly positioned in sling 1 by utilizing a lifting apparatus which engages sling 1 at lifting eye 5. The handicapped person as thusly supported can be lifted and transported from place to place without having to manually lift or manipulate either the person or the sling. Moreover, flexible material 11 as attached to tubular members 20 by sling portions 13, slidably engages the tubular members so as to be forcibly adjustable along the horizontal section of base portion 25. This feature not only permits centering of the weight of the patient suspended but will also allow the attendant to shift the weight to the patients arms or legs, whichever are more capable of or may more comfortably support the patient, assuming partial disability of either.

It will be apparent from the foregoing that numerous alternative embodiments will occur to those of ordinary skill in the art without departure from the spirit or the scope of the present invention. Most especially, numerous design options with respect to the construction, configuration and interconnection of the various elements comprising the present invention may be altered by those of ordinary skill in the art without departure from the spirit or the scope of the present invention.

I claim:

1. A sling for lifting and supporting a handicapped person comprising:

a pair of members;

first means forming an overhead sling and slidably engaging said members for supporting said members and maintaining head clearance for said person;

second means pivotally engaging said members for retaining said members in spaced relation while permitting same to pivot about said second means;

a pair of leg slings, each adjustably secured to said second means for engagement with and support of each of the upper legs of said person; and a pair of arm slings, each adjustably secured to each of said members forming means for engagement with and support of each of the forearms of said person, whereby said person is supported by said arm and leg slings.

2. A sling for lifting a handicapped person as in claim 1, further comprising a pair of third means each secured to one of said members and one of said arm slings, for restraining the arms of said patient from flaying outwardly.

3. A sling for lifting a handicapped person as in claim 1, wherein said first means further comprising a rigid portion having a rigid support and a flexible portion, wherein said flexible portion comprises a flexible material which is secured to said rigid support and has a length sufficient to extend from said rigid support forming two flexible portions each of which engage said members.

4. A sling for lifting a handicapped person as in claim 3, further comprising a pair of underarm cushions integral with said members.

5. A sling for lifting a handicapped person as in claim 1, wherein said members each have:

an L-shaped front end portion having a first portion which parallels the upper leg of said person, and a second portion integral with said first portion which substantially parallels the torso of said person;

a rear-end portion integral with said second portion of said L-shaped front end portion, said rear-end portion forming an inverted U-shaped member.

6. A sling for lifting and supporting a handicapped person comprising:

a pair of members each having an L-shaped front end portion having a first portion which parallels the upper leg of said person, and a second portion integral with said first portion which substantially parallels the torso of said person, and a rear-end portion integral with said second portion of said L-shaped front end portion, said rear-end portion forming an inverted U-shaped member;

first means having a flexible portion, forming an overhead sling and slidably engaging said members for supporting said members and maintaining head clearance for said person, wherein said flexible portion of said first means slidably engages said rear-end portion along the base of said inverted U-shaped member, said arm slings engaging said base of said inverted U-shaped member at a position further from said front end portion than where said flexible material engages said U-shaped member;

second means pivotally engaging said members for retaining said members in spaced relation while permitting same to pivot about said second means;

a pair of leg slings, each adjustably secured to said second means for engagement with each of the upper legs of said person; and a pair of arm slings, each adjustably secured to each of said members for engagement with each of the forearms of said person.

7. A sling for lifting a handicapped person as in claim 6, wherein said second portion of said L-shaped portions constitutes means for said person to grasp and steady oneself whereby said members pivot inwardly or outwardly to comfortably accommodate the body of said person.

8. A method for supporting a handicapped person using said sling as in claim 1 comprising the steps of:

(a) engaging said person's upper legs with said leg slings; and (b) engaging said person's forearms with said arm slings whereby said person is fully supported by said sling.

* * * * *